United States Patent [19]

Stewart et al.

[11] Patent Number: 5,003,997

[45] Date of Patent: Apr. 2, 1991

[54] MANICURING AID FOR INFANTS

[76] Inventors: Christopher O. Stewart; Karen Suprise-Mansfield, both of 222 Kearny St., Suite 500, San Francisco, Calif. 94108

[21] Appl. No.: 448,538

[22] Filed: Dec. 11, 1989

[51] Int. Cl.[5] ..... A45D 29/00

[52] U.S. Cl. ..... 132/73; 128/879; 128/880

[58] Field of Search ..... 132/73, 333; 128/878, 128/879, 880; D28/56, 61; 272/67, 68, 116, 119, 126, 139, 122, 123, DIG. 9; 446/227, 296, 304, 313

[56] References Cited

U.S. PATENT DOCUMENTS

| | | | |
|---|---|---|---|
| D. 142,177 | 8/1945 | Walsh | D28/56 |
| D. 158,223 | 4/1950 | Schubert et al. | 132/73 |
| D. 159,662 | 8/1950 | Patek | D28/56 |
| D. 226,736 | 4/1973 | Benis | D86/10 C |
| 2,223,204 | 11/1940 | Carmichael | 132/73 |
| 2,392,626 | 1/1946 | Young | 132/73 |
| 2,396,154 | 3/1946 | Campbell | D28/56 |
| 2,461,695 | 2/1949 | McMahon | 132/73 |
| 2,546,118 | 3/1951 | Wright | 132/73 |
| 2,622,534 | 12/1953 | Swartz | 132/73 |
| 2,798,482 | 7/1957 | Feeney | 128/880 |
| 4,218,057 | 8/1980 | Wilson | 272/119 |
| 4,296,766 | 10/1981 | Benis | 132/73.5 |
| 4,351,526 | 9/1982 | Schwartz | 272/119 |
| 4,585,017 | 4/1986 | Trujillo | 132/73 |

OTHER PUBLICATIONS

Washington Post Magazine Article; "Heavyhands", 02/17/1983.

*Primary Examiner*—John J. Wilson
*Assistant Examiner*—Frank A. LaViola

[57] ABSTRACT

A manicuring aid for use with infants between the ages of six months and two years old has a hollow cylindrical body (10) of pliable plastic. The body (10) has shallow grooves (24) for guiding and separating the fingertips; a support ledge (26) for supporting the fingertips; and a loop (28) through which an elastic restraining strap (18) for restraining and controlling finger movement is drawn. The strap (18) comprises two strips (20) and (22) with hook-and-loop fasteners and is fixed within an interior cavity (16) which is revealed when the end (12) of the body is removed.

8 Claims, 4 Drawing Sheets

MANICURING AID FOR INFANTS

BACKGROUND—FIELD OF INVENTION

This invention relates to manicuring aids, specifically to those that facilitate and expedite the cutting of fingernails.

BACKGROUND—DESCRIPTION OF PRIOR ART

There are several reasons for keeping infants' fingernails trimmed short. Dirt may get under long fingernails, and such dirt can later be easily transferred so as to deposit potentially harmful germs in the infant's mouth and eyes. With neatly trimmed fingernails, an infant is less likely to scratch itself, other children, or anyone holding the child. Attempting to cut an infant's tiny fingernails can be arduous and difficult. Children from the age of six months old to two years old have limited control of their muscles. Children of this age also have a short attention span and are not apt to tolerate uncomfortable situations. Some infants are afraid of the fingernail cutting activity. First, the child is reluctant to have its hand restrained. Secondly, as the person cutting the fingernails tries to hold the hand, the child will often try to pull the hand away or make a fist, digging its fingertips into the palm of its hand. It may see the hand-holding as a suggestion for play, or may be afraid of the restraint. If the child is wriggling its fingers or trying to pull its hand away, it is easier to accidentally cut the skin, cut the fingernail too short, or cut the fingernail crooked, leaving a jagged edge.

One method often resorted to is to have the child grasp the finger of the person cutting the fingernails or a stationary round object, such as the rail on a baby crib. This is because it is natural for the child to grip a long, slender object. However, even if the child is grasping a finger, a baby crib rail, or a similar cylindrical object, its hand must still be held in place and its fingertips spread apart enough to prevent accidental cutting of the skin. Although the child is able to instinctively grip by this method, the person cutting the fingernails must still hold its hand to the crib rail or cylindrical object. This entails trying to hold and separate the fingers, and cut the fingernails simultaneously. One may also try to hold and cut just one fingernail at a time. However, from this the child will attempt to pull its hand away. They may also turn their wrist and hand in an attempt to pull it free. Another method is waiting for the child to fall asleep. However the cutting would have to be done in low light which makes it difficult to see the fingernails and increases the chance of cutting the skin with the fingernail clippers, whereby the child is easily awakened.

There have been several types of manicuring devices designed in the past to restrain and control finger movement and separate the fingertips. For example, U.S. Pat. No. 2,223,204 to Carmichael (1940) discloses a manicuring device that provides a finger support and deep grooves that separate the fingers and a pivoted latch for restraining and controlling finger movement. However, Carmichael's device is for the application of fingernail polish. If used on an infant, its fingers would have to be inserted into the grooves one at a time. The preferred embodiment of the pivoted latch is wire and is of fixed length. To effectively restrain and control an infant's finger movement, the latch would have to be tight and uncomfortable. Also, because of the device's flat shape, the child can still make a fist. The wire latch is not adjustable to accommodate different hand sizes as the child grows. Finally, the device is not designed for an infant.

U.S. Pat. No. 2,546,118 to Wright (1951) discloses a hand restrainer that limits the movement of the fingers. Once again, if used on an infant, its fingers would have to be inserted into the finger holes one at a time, a difficult task if the child is pulling its hand away. The holes are not adjustable to accommodate hand growth nor different sized hands. While holding the device the child is still able to easily make a fist by digging its fingernails into its palms. Since the device separates the fingers and does not restrain finger movement, the fingers may be accidentally cut.

U.S Pat. Des. No. 142,177 to Walsh (1945) and U.S Pat. No. 2,461,695 to McMahon (1949) disclose flat manicuring accessories to be gripped by the hand. These require the user to grasp the devices by bending the fingers and thumb at the first knuckle nearest the fingertip. An infant would not be able adequately to grasp the device because of its limited strength and motor control. In addition, since these devices are dependent upon the voluntary effort and patience of the user to continually grasp the device while it is in use, there is nothing to restrict and control finger movement.

U.S. Pat. Des. No. 226,736 to Benis (1973) discloses a finger manicuring grip that provides a shape easily grasped by an infant. However, this device is also dependent upon the voluntary effort of the user to continually grasp the device while it is being used. Use on an infant would entail trying to hold and separate the fingers and cut the infant's fingernails simultaneously because there is nothing to restrict and control finger movement.

U.S. Pat. Nos. 2,622,534 to Swartz (1950), 4,296,766 to Benis (1981), 4,585,017 to Trujillo (1986), and U.S. Pat. Des. No. 158,223 to Schubert et al (1950) all disclose manicuring aids and finger supports for the application of nail polish. Using them on an infant will create many of the same problems indicated above. Although they spread and support the fingertips, their use is limited and not applicable to infants ages six months to two years old.

U.S. Pat. Nos. 4,218,057 to Wilson (1980) and 4,351,526 to Schwartz (1982) disclose hand grip devices to be used during aerobic exercise, employing a looped cord and a strap of limited adjustment respectively to prevent devices from falling from the hand if grip is relaxed, but do not restrain finger movement.

U.S. Pat. No. 2,798,482 to Feeney (1957) discloses an infant accessory device comprising a handle for gripping but does not have finger grooves. The device attaches to an infant's hand by means of an elastic strap of fixed length limiting its accommodation of various hand sizes and tension adjustment.

In summation, all the manicuring aids heretofore known suffer from a number of disadvantages:

(A) They are designed as manicuring accessories for mature persons for fingernail polish application.

(B) The devices are not designed to placate an infant. The unpleasing shape and the coercion necessary to apply them to infants could serve to make the child more reluctant to the fingernail cutting activity.

(C) The devices do not allow the child to grip naturally or otherwise keep the hand in a natural, comfortable position. This could increase the child's reluctance to the fingernail cutting activity.

(D) The devices are dependent on the voluntary effort and patience of the user to continually grasp the device while it is in use.

(E) The devices do not provide an adjustable means for restraining and controlling finger movement that accommodates different sized hands and growth of the hand.

(F) The devices, if applied to an infant, are dependent upon the person trimming the fingernails to hold and separate the fingers and cut the fingernails simultaneously.

(G) The manicuring devices do not provide a means for storing the manicuring tools, such as the fingernail clippers when not in use.

OBJECTS AND ADVANTAGES

Several objects and advantages of the present invention are:

(A) To provide a manicuring aid designed specifically to be used with infants, ages six months to two years old, as an aid to facilitate, expedite, and make safer the cutting of the fingernails and make the child have a more pleasurable association with the fingernail cutting activity.

(B) To provide a manicuring aid that can distract the child's attention away from the fingernail cutting activity, the fingernail clippers, and the fact the fingers are being restrained.

(C) To provide a manicuring aid that encourages and accommodates an infant's natural and limited ability to grip an object in a comfortable manner, whereby making the fingernail cutting less fearful and not dependent upon the child having to continually grasp the device.

(D) To provide a manicuring aid that does not require an infant's voluntary effort to continually grasp the device while it is in use.

(E) To provide a manicuring aid with a means of comfortably, yet firmly, restricting and controlling finger movement and accommodating different sized hands and the growth of the hands.

(F) To provide a means to separate the fingertips and hold them apart during the fingernail cutting act to relieve the person cutting from the added necessity of holding the fingers steady and the fingertips apart while attempting to cut the fingernails.

(G) To provide a manicuring aid with a means for storing the fingernail cutting tool and elements of the manicuring aid when not in use.

Accordingly, further objects and advantages are to provide a manicuring aid that is small and portable, simple to use, and inexpensive to manufacture; that is interchangeable between the right and left hands; that is easy to clean with soap and water; that may serve as a toy because its shape may be incorporated in a larger form and all parts are non-toxic and has no small pieces that may be swallowed. Still further objects and advantages will become apparent from a consideration of the following description and drawings.

DRAWING FIGURES

In the drawings, closely-related figures have the same numbers but different alphabetic suffixes.

Reference Numerals in Drawings

Figure 1:
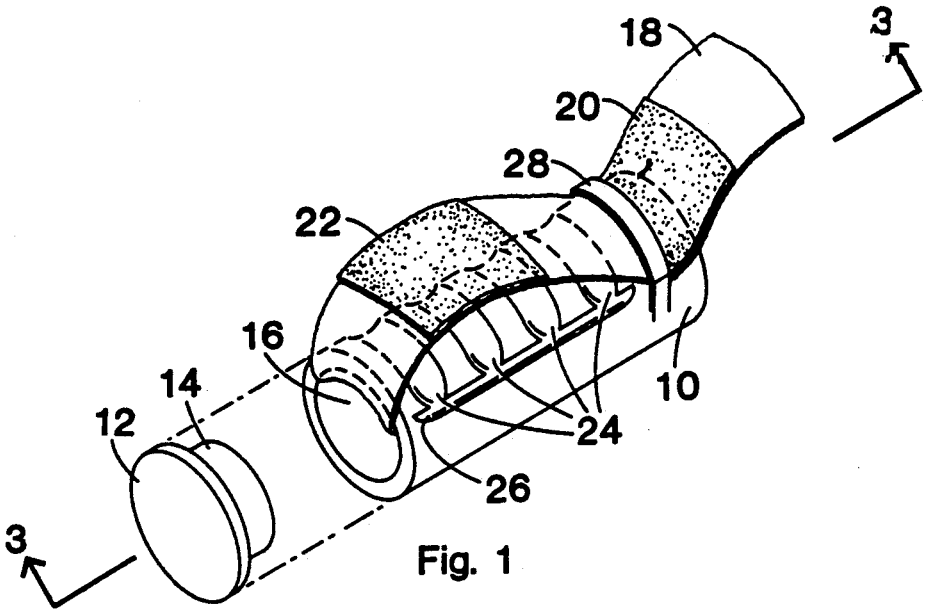
FIG. 1 is a perspective view from one end of a manicuring aid in accordance with a preferred embodiment of the present invention.

10 body
12 end
14 sleeve
16 interior cavity
18 elastic restraining strap
20 hook-and-loop strip
22 hook-and-loop strip
24 four shallow groves
26 support ledge
28 loop
30 infant's hand
32 roof
34 fingernail clipper

DESCRIPTION—FIGS. 1, 2, 3, and 5

A typical embodiment of a manicuring aid for an infant according to the present invention is illustrated in FIGS. 1 and (perspective views). The manicuring aid comprises a hollow cylindrical barrel or body 10. In the preferred embodiment, body 10 is approximately 89 mm (3.5 inches) in length, has a diameter of approximately 38 mm (1.5 inches), and a thickness of 2 mm (0.078 inch) In the preferred embodiment, body 10 is of a pliable, semi-rigid, non-toxic plastic, such as the vinyl sold under the trademark EXCELON RNT by Thermoplastic Processes, Inc. of Stirling, N.J. However, other pliable, semi-rigid, non-toxic, plastics may be used.

Figure 2:
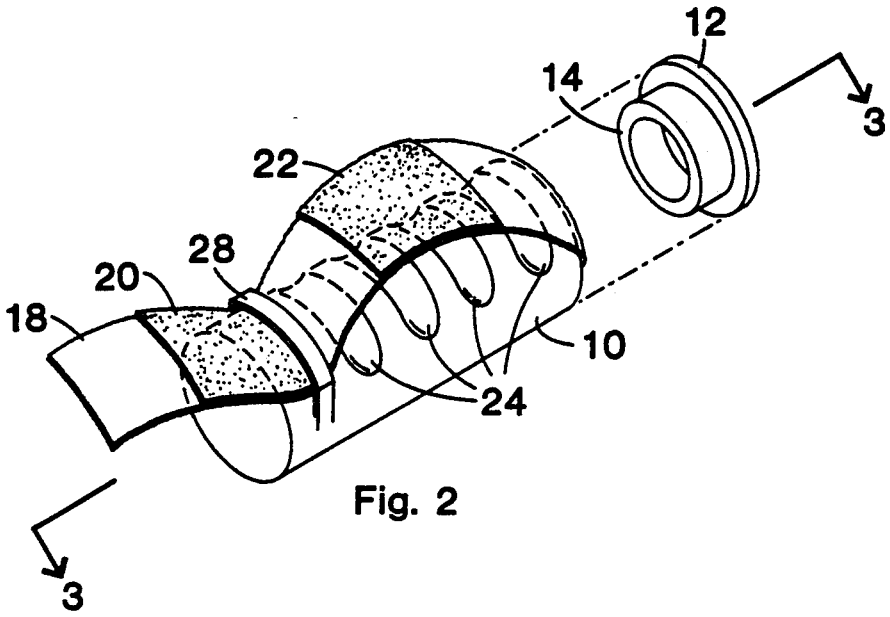
FIG. 2 is a perspective view from the other end of the same device.

End 12 is removable from body 10 as illustrated in FIGS. 1 and 2, and reveals an interior cavity 16. Integral to end 12 is a sleeve 14 that fits snugly into cavity 16. An elastic restraining strap 18 is stored within interior cavity 16. The cavity protects strap 18 from becoming soiled. Strap 18 is approximately 152 mm (6 inches) long and 25 mm (1 inch) wide.

Figure 3:
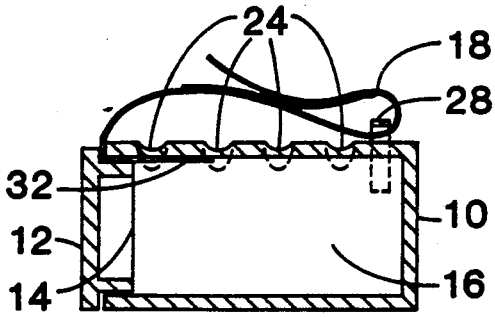
FIG. 3 shows a longitudinal sectional view of the manicuring aid taken as indicated by line 3—3 in FIGS. 1 and 2.

In the preferred embodiment, strap 18 is elasticized cloth. About 25 mm (1 inch) of strap 18 is attached with non-toxic glue to the roof 32 of cavity 16, as illustrated in FIG. 3. Strap 18 is fixed so that it extends longitudinally along the axis of body 10, as illustrated in FIGS. 1 and 2. If strap 18 is extended flat from the body, it will have an underside and a top side. At the underside of the remaining approximately 127 mm (5 inches) of strap 18 are mating hook-and-loop strips 20 and 22, such as sold under the trademarks VELCRO and LATCHLOCK. Each strip is approximately 25 mm (1 inch) in length and as wide as strap 18. Strips 20 and 22 are glued with non-toxic adhesive and/or sewn to strap 18; on strip 20 the glued part starts at 28 mm (1.18 inches) from the end, and on strip 22, 19 mm 0.75 inch) from strip 20.

Integral to body 10 as illustrated in FIGS. 1, 2, and 3 are four shallow grooves 24 that act as finger guides. Grooves 24 are similar to a bicycle handle bar's grip, and are for separating the fingers of a infant's hand when the manicuring aid is applied. Grooves 24 are oriented orthogonally to body 10 and are approximately 38 mm (1.5 inches) in length and 6 mm (0.25 inch) wide.

At one end of grooves 24 and integral to the body 10 is a raised support ledge 26 approximately 3 mm (0.125 inch) in diameter and 57 mm (2.25 inches) long so as to extend the length of grooves 24, as shown in FIG. 1. Ledge 26 supports the fingertips when the fingers of the infant's hand are in grooves 24.

Also integral to and at the end of body 10 and opposite end 12 is a flat loop 28 approximately 29 mm (1.125 inches) long with a thickness of approximately 2 mm (0.0625 inch) and a clearance between body 10 and loop 28 of approximately 3 mm (0.125 inch).

Figure 5:
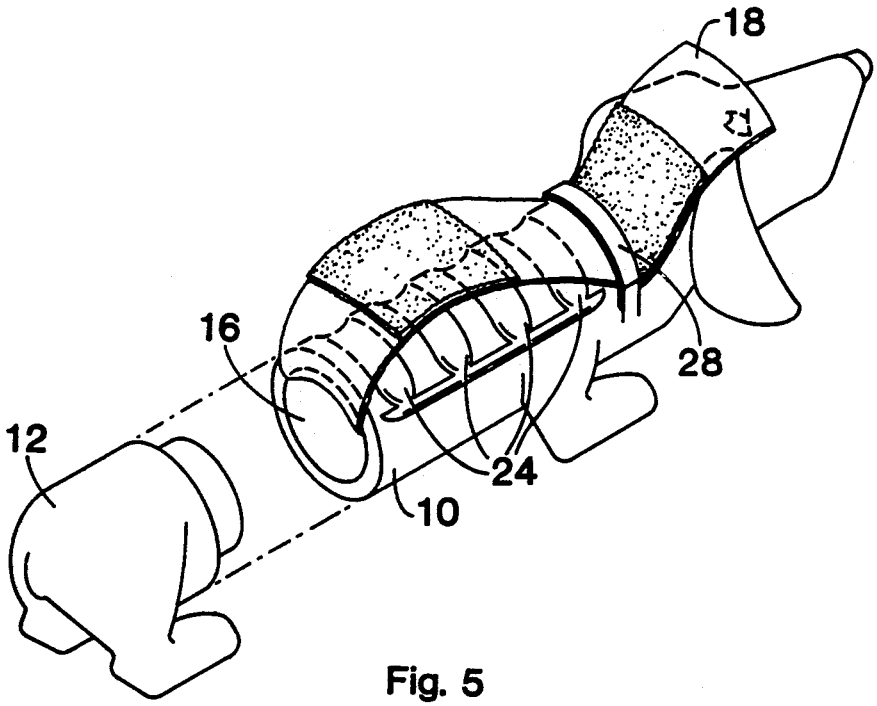
FIG. 5 is a perspective view from one end of the manicuring aid in the form of a toy, i.e., a dog.

FIG. 5 shows the manicuring aid shaped as a toy dog. The components of the manicuring aid are the same as those described above. In the preferred embodiment, body 10 is the torso of a dachshund dog with integral head and front legs. End 12 is the hind legs of the dog and is removable from body 10, providing access to interior cavity 16 and strap 18 stored therein. Grooves 24 are oriented orthogonally to body 10 and are on the backbone of the dog. Loop 28 is the dog's collar.

OPERATION—FIGS. 4A to 4E

Figure 4A:
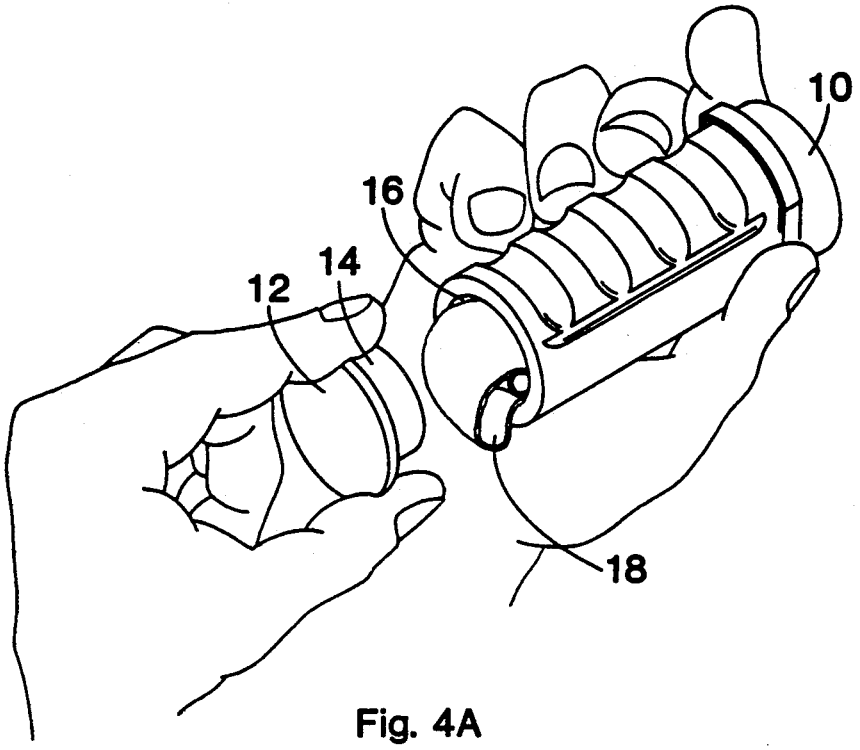
FIGS. 4A to 4E show perspective views of the preferred embodiment of the manicuring aid and its preferred application.
Figure 4B:
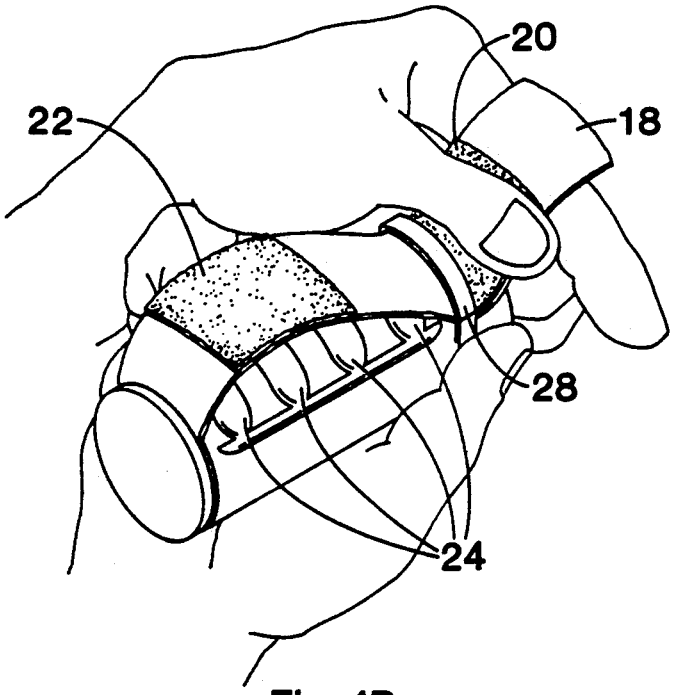

The following description assumes that the manicuring aid of the present invention is applied to an infant's left hand. It should not be construed as limiting the scope of this invention, as the manicuring aid is equally applicable to the right hand. FIG. 4A and 4B illustrates how the manicuring aid of the present invention is readied for use.

As shown in FIG. 4A, end 12 is first removed from body 10 with a slight twisting and pulling motion, providing access to interior cavity 16 and strap 18 stored therein. If desired, a fingernail cutting instrument (not shown) may also be stored in cavity 16. Strap 18 is extracted from cavity 16 and drawn across grooves 24 through loop 28, as shown in FIG. 4B.

Figure 4C:
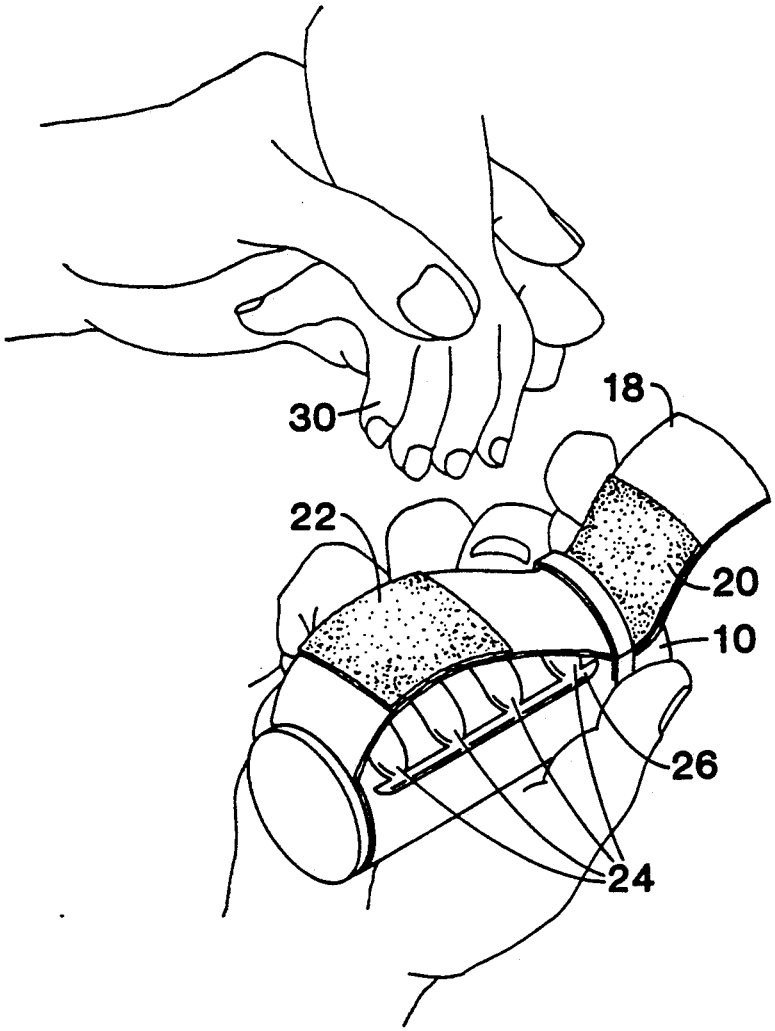

After strap 18 is in place, end 12 is replaced by reinserting sleeve 14 into cavity 16 with a slight twisting and pushing motion. However, it is not necessary that end 12 be replaced before employing the manicuring aid. FIG. 4C illustrates how an infant's hand is drawn to a manicuring aid. The person cutting the fingernails takes hold of the infant's hand 30 in one hand and the manicuring aid in the other. Hand 30 is then guided between strap 18 in its flaccid state and body 10 as illustrated in FIG. 4C. The infant's fingers are placed in grooves 24 with the first joints below the fingertips placed on ledge 26.

Figure 4D:
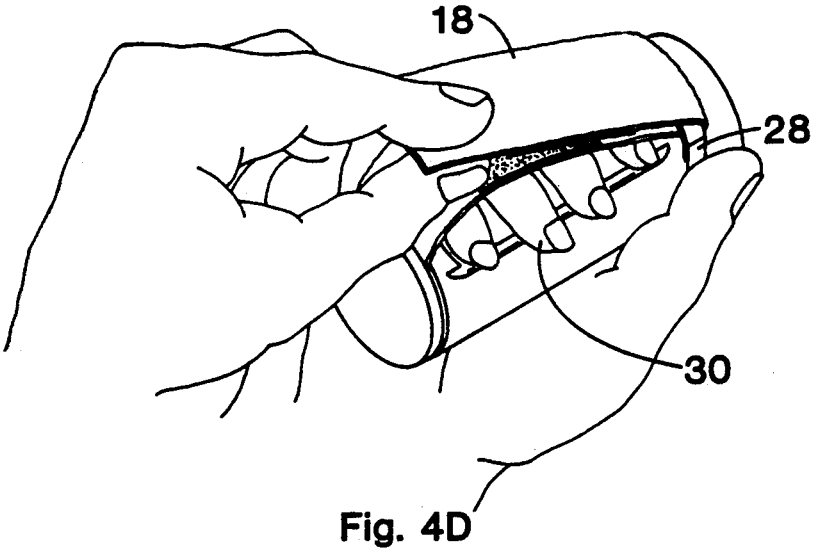

Due to the tendency of the infant to grasp the manicuring aid, the thumb will either wrap around body 10 opposite the fingers or will move about freely. This does not affect the other fingertips because they are separated from each other, so the thumb is separated from the other fingers. While the person cutting is holding the manicuring aid applied to the infant's hand 30 in one hand, the person's other hand is free to tighten strap 18, as shown in FIG. 4D. Strap 18 may be tightened by further drawing it through loop 28 and doubling back over itself and the fingers. When strap 18 is tight enough to restrain and control movement of the fingertips without causing the infant discomfort, strip 20 is pressed to strip 22 to hold strap 18 in place. Adjustments in tension are made by separating strips 20 and 22 and pressing them together again once desired tension is reached. To adjust separation of the fingertips, the person manicuring spreads the fingertips farther apart or closer together while strap 18 is in place.

Figure 4E:
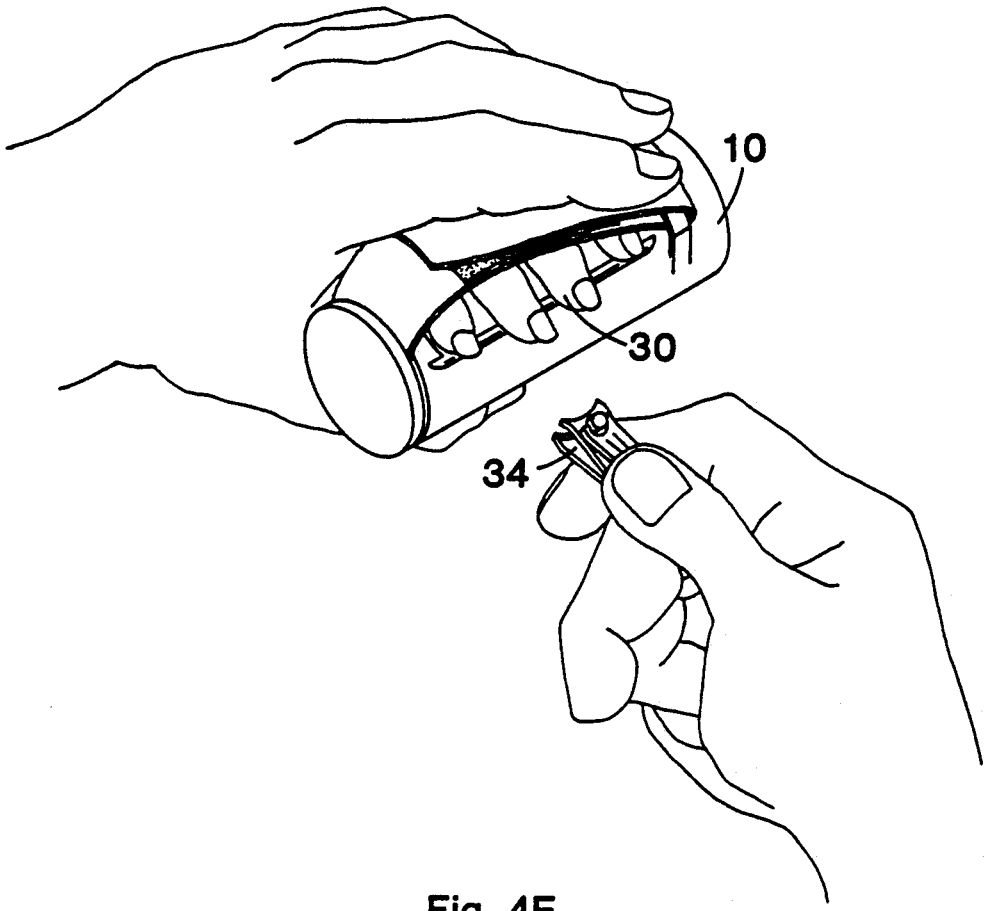

FIG. 4E illustrates the fingernail cutting activity. The infant's hand with the manicuring device is held in one of the manicurist's hands while the other manicurist's hand cuts the fingernails with a fingernail clipper 34. The fingernail of the thumb is cut by pressing it to body 10, or by holding it between the manicurist's thumb and forefinger and cutting the fingernail.

After the fingernails have been cut, strips 20 and 22 are separated, thereby releasing tension on strap 18. The infant's hand is removed from the manicuring aid. For cutting the fingernails of the infant's other hand, the above operation is repeated.

When the fingernail cutting activity is completed and the infant's hand is withdrawn from the manicuring aid, end 12 is removed as described above and illustrated in FIG. 4B. Strap 18 is withdrawn through loop 28 and pushed into cavity 16. End 12 is replaced as described above and as illustrated in FIG. 4D.

SUMMARY, RAMIFICATIONS, AND SCOPE

Accordingly, the reader will see that the manicuring aid of this invention can be used to facilitate and expedite the cutting of infants' fingernails. Furthermore, the manicuring aid has the additional advantages in that:

it provides a manicuring aid tailored to the small size of infants' hands.

it provides a manicuring aid easily adaptable to the form of a toy to distract the child's attention from the fact the hand is being restrained and the fingernail cutting activity, so the child may have a pleasant association with the cutting activity.

it provides an object which is easily and naturally grasped by the infant without coercion.

it provides a manicuring aid that separates the fingertips and holds them apart for easier and safer fingernail cutting and relieves the person cutting the fingernails from the additional necessity and difficulty of holding the fingers apart.

it provides a manicuring aid that when applied to an infant's hand, does not require the person cutting the fingernails to hold the manicuring aid in place.

it provides a manicuring aid with an elastic strap that permits the adjustment of the tension required to restrain and control finger movement so the hand may be comfortably restrained, and allow for growth in infants' hands.

it permits the storage of the fingernail cutting tool and elements of the manicuring aid inside the device when not in use so that they may be kept clean and together for easy retrieval.

it allows the user to concentrate on cutting the fingernails, rather than struggling with the child's hand, thereby minimizing the chances of accidentally cutting the skin.

Although the above description contains many specificities, these should not be construed as limiting the scope of the invention but as merely providing illustrations of some of the presently preferred embodiments of this invention. For example, the appearance of the manicuring aid can vary in shape and color without affecting the function of the device. It may be oval, rectangular, or barrel-shaped. In addition, the end of the elastic restraining strap may be removably attached to the device. Thus the scope of the invention should be determined by the appended claims and their legal equivalents, rather than by the examples given.

We claim:

1. A manicuring aid for controlling the finger movement of an infant between the ages of about six months and two years old to facilitate cutting said infant's fingernails, comprising a cylindrical barrel of a size which can be comfortably grasped by a hand of said infant, said cylindrical barrel having a cavity therein, enclosed by an end wall integral with the structure of the barrel and an opposing end wall which is removable to allow access to said cavity, the barrel having four parallel finger grooves oriented orthogonally to the axis of the barrel, a raised fingertip support ledge, an adjustable elastic cloth strap affixed at one end at said cavity adjacent said end wall which is removable, and a loop projecting from the barrel oriented parallel and adjacent to the four finger grooves.

2. The manicuring aid of claim 1 wherein said cylindrical barrel is made of a resilient, pliable, plastic material which is not toxic whereby it will not be harmful if brought into contact with said infant's mouth.

3. The manicuring aid of claim 1 wherein said opposing end wall which is removable comprises a sleeve of a diameter equal to the diameter of said cavity whereby when the removable end is replaced it will ensure a snug fit.

4. The manicuring aid of claim 1 wherein said four parallel finger grooves are shallow and spaced close together whereby the fingers of said infant are spread apart slightly when placed in the finger grooves while gripping said cylindrical barrel.

5. The manicuring aid of claim 1 wherein said raised fingertip support ledge projects from said cylindrical barrel and is oriented longitudinally to the axis of the barrel and being perpendicular and adjacent to one side of said four parallel finger grooves whereby the fingertips of said infant rest upon the support ledge when the fingers of said infant are placed in the finger grooves while gripping said cylindrical barrel.

6. The manicuring aid of claim 1 wherein said adjustable elastic cloth strap is affixed to the interior of said cavity with an adhesive which is not toxic whereby it will not be harmful if brought into contact with said infant's mouth.

7. The manicuring aid of claim 1 wherein said adjustable elastic cloth strap has two attached hook-and-loop strips whereby the strap can be readily adjusted to accommodate different hand sizes and to ensure restraint of finger movement of said infant.

8. The manicuring aid of claim 1 wherein said loop projects from said cylindrical barrel adjacent to said end wall integral with the structure of the barrel through which said adjustable elastic cloth strap is drawn whereby the strap is drawn back over itself in order to attach said two hook-and-loop strips.

* * * * *